US009411316B2

(12) United States Patent
Pages et al.

(10) Patent No.: US 9,411,316 B2
(45) Date of Patent: Aug. 9, 2016

(54) TILTING COUPLING DEVICE FOR TIMEPIECE

(71) Applicant: Société anonyme de la Manufacture d'horlogerie Audemars Piguet & Cie, Le Brassus (CH)

(72) Inventors: Marc-Olivier Pages, Vernier (CH); Giulio Papi, La Chaux-de-Fonds (CH); Lauren Musitelli, La Chaux-de-Fonds (CH); Johan Montet, Baulmes (CH)

(73) Assignee: Société anonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 0 days.

(21) Appl. No.: 14/743,948

(22) Filed: Jun. 18, 2015

(65) Prior Publication Data

US 2015/0370221 A1 Dec. 24, 2015

(30) Foreign Application Priority Data

Jun. 19, 2014 (CH) ..... 0933/14

(51) Int. Cl.

| | |
|---|---|
| ***G04F 7/00*** | (2006.01) |
| ***G04B 27/02*** | (2006.01) |
| ***G04B 27/04*** | (2006.01) |
| ***G04F 7/08*** | (2006.01) |
| ***G04B 27/06*** | (2006.01) |

(52) U.S. Cl.

CPC ..... *G04B 27/04* (2013.01); *G04B 27/02* (2013.01); *G04B 27/023* (2013.01); *G04B 27/06* (2013.01); *G04F 7/08* (2013.01); *G04F 7/0823* (2013.01); *G04F 7/0828* (2013.01); *G04F 7/0838* (2013.01)

(58) Field of Classification Search

CPC ... G06F 7/0823; G06F 7/0828; G06F 7/0833; G04B 27/00; G04B 27/023; G04B 27/024; G04B 27/02; G04B 27/04; G04B 27/045; G04B 27/06

See application file for complete search history.

(56) References Cited

U.S. PATENT DOCUMENTS

| | | | | |
|---|---|---|---|---|
| 261,655 A | | 7/1882 | Bitner | |
| 413,654 A | | 10/1889 | Flint | |
| 2,532,943 A | * | 12/1950 | Riemer | G04B 27/00 368/185 |

(Continued)

FOREIGN PATENT DOCUMENTS

| | | |
|---|---|---|
| CH | 2547 | 12/1890 |
| CH | 613 588 A3 | 10/1979 |

(Continued)

*Primary Examiner* — Amy Cohen Johnson
*Assistant Examiner* — Daniel Wicklund
(74) *Attorney, Agent, or Firm* — Christensen Fonder P.A.

(57) ABSTRACT

A coupling device for timepieces that includes an entry wheel, a coupling wheel, and a first exit wheel. The coupling wheel is disposed substantially coplanar to the plane of rotation of the entry wheel and of the first exit wheel and is adapted to tilt relative to the plane of rotation to occupy a first coupling position in which the coupling wheel meshes with the first exit wheel and a second coupling position in which the coupling wheel is decoupled from the first exit wheel. The device also includes a movable element to control the change of position between the first and the second position of the coupling wheel. The coupling wheel defines an axis of rotation that can be inclined relative to the normal to the plane of rotation of the entry wheel and of the first exit wheel by being mounted pivotably at each of the ends thereof.

21 Claims, 9 Drawing Sheets

(56) References Cited

U.S. PATENT DOCUMENTS

| | | | | |
|---|---|---|---|---|
| 4,415,277 | A | 11/1983 | Ganter | |
| 4,862,434 | A | 8/1989 | Hiraga et al. | |
| 6,773,157 | B1 | 8/2004 | Grau | |
| 2003/0161219 | A1 * | 8/2003 | Kojima | G04B 27/02 368/190 |
| 2004/0004908 | A1 * | 1/2004 | Watanabe | G04C 9/00 368/190 |
| 2004/0066711 | A1 * | 4/2004 | Haefeli | G04F 7/0828 368/101 |
| 2009/0122655 | A1 | 5/2009 | Golay | |
| 2013/0148476 | A1 * | 6/2013 | Mertenat | G04F 7/0842 368/103 |
| 2013/0201801 | A1 * | 8/2013 | Calabrese | G04B 27/00 368/34 |
| 2014/0177397 | A1 * | 6/2014 | Rudaz | G04B 27/04 368/191 |

FOREIGN PATENT DOCUMENTS

| | | | | | |
|---|---|---|---|---|---|
| CH | 642 217 | A3 | | 4/1984 | |
| CH | 644 978 | A3 | | 9/1984 | |
| CH | WO 03021364 | A2 | * | 3/2003 | G04B 27/00 |
| CH | 700 959 | A2 | | 11/2010 | |
| DE | 127 363 | | | 9/1977 | |
| EP | 0 261 243 | A1 | | 3/1988 | |
| EP | 1 288 742 | A1 | | 3/2003 | |
| EP | 2 060 958 | A2 | | 5/2009 | |
| FR | 436356 | | | 3/1912 | |
| FR | 2 335 881 | A1 | | 7/1977 | |
| GB | 24284 | | | 7/1912 | |
| GB | 2 086 101 | A | | 5/1982 | |
| JP | WO 8706031 | A1 | * | 10/1987 | G04B 27/00 |

* cited by examiner

TILTING COUPLING DEVICE FOR TIMEPIECE

RELATED APPLICATION

The present application claims priority to Swiss Patent Application No. 0933/14, filed Jun. 19, 2014, the disclosure of which is hereby incorporated by reference herein in its entirety.

FIELD OF THE INVENTION

The present invention relates to a coupling device for timepieces, in particular for time-setting devices or for chronograph watches, including timepieces having a mechanical movement, such as mechanical wristwatches.

BACKGROUND OF THE INVENTION

Timepieces having a mechanical movement, including mechanical wristwatches, are often equipped with a number of functions, in particular where fine watchmaking pieces are concerned, and thus normally has a control device having three positions, corresponding for example to the winding of the watch, the fast correction of the date, and the setting of the time, thus requiring a coupling in order to attribute the different functions to the corresponding positions of the control device. The conventional coupling used in this case consists of a corrector yoke controlled by a control stem and displaceable by a pivot motion over a short distance that amounts to a translation. The yoke comprises a mounted coupling and setting wheel adapted to mesh with, respectively be disconnected from a corrector wheel, depending on the position of the yoke. The coupling by translation, however, has the disadvantage that it may induce, in some circumstances, a parasitic rotation of the corrector wheel associated with the displacement of the mounted setting wheel along the circumference of this corrector wheel. This may produce, for example, a slight jump, forwards or backwards, of the minutes hand when the user of the timepiece pushes the control stem after having set the time, which is clearly an inconvenience. In addition, this type of coupling takes up a fair amount of space and therefore is not suitable for use in extra-flat movements. An additional feature, with which numerous timepieces are provided, consists of a chronograph mechanism. This feature also requires a coupling, the conventional coupling mechanism used for this application likewise being based on a movement equivalent to a translation of a mounted coupling and setting wheel. In this case the translation of the mounted coupling and setting wheel produces the start, respectively the stopping of the measurement of the measured time by establishing, respectively by interrupting the kinematic connection between the geartrain of the movement of the timepiece and the chronograph train. This, however, brings problems due to the fact that, as in the case described above of setting the time, the translation of the mounted coupling and setting wheel can, in some circumstances, cause a parasitic rotation of the chronograph train and, consequently, a jump forward of the chronograph hand. Although this does not influence the reading of the measured time because the gear play is made up subsequently, it is an aesthetical problem at the moment of actuation of the chronograph that should be eliminated. There are also other applications that require a coupling in a timepiece that are affected by similar problems.

In this context, solutions have been proposed in order to reduce or eliminate the above-mentioned problems. For example, European patent application EP 2 060 958 discloses, within the scope of a coupling for a chronograph mechanism, a gearwheel comprising a toothing of specific form, in particular having teeth having a foot and a head of particular form. In addition, the axis of the coupling and setting wheel is placed, by contrast with the arrangement of a conventional chronograph, over the line between the axes of the seconds wheel and the chronograph wheel, and the shape of the coupling yoke, disposed such as to be adapted to bring said setting wheel into engagement with the chronograph wheel or to distance same, allows to obtain a translation of the coupling and setting wheel during the movement thereof between the two decoupled and coupled positions thereof oriented almost perpendicularly to the circumference of the chronograph wheel. Thus, the coupling and setting wheel does not move in translation along the circumference of the chronograph wheel, which limits the above-mentioned parasitic rotation. This layout, however, requires a complicated toothing on the coupling device setting wheel and increases the production cost. At the same time, the space occupied by this mechanism remains considerable, and the mechanism requires a specific arrangement of the parts thereof relative to one another, which limits the use thereof both for functions other than a chronograph and in extra-flat movements.

As a result, other types of coupling have also been proposed in the past. Amongst others, U.S. Pat. No. 6,773,157 discloses a time correction device comprising a winding stem cooperating on the one hand, as is conventional, with a minutes hand and hours hand correction train, by means of a first correction wheel. On the other hand, the device comprises a second correction wheel, which is mounted on a fixed axis partially having the form of a cone so that the second correction wheel can be inclined about this axis, depending on the position of a control spring controlled by the stem and cooperating with another spring exerting a prestressing force onto the second correction wheel. Depending on its inclination, the second correction wheel may or may not mesh with part of said correction train, and, when it is in the meshing position, the winding stem does not mesh with said first correction wheel. Although this device can, in principle, be used for several applications such as the fast adjustment of the hours hand independently of the minutes hand or for the correction of the date, the mechanism is even more bulky than a conventional coupling and does not lend itself to integration in a flat movement. In addition, the use of a fixed truncated conical axis of rotation in combination with a control of the inclination of the coupling pinion mounted on this axis by a number of springs does not appear to ensure reliable operation.

Further designs using a tilting coupling wheel, either by being mounted on a fixed axis of rotation or by other similar means, are disclosed in documents DD 127 363 and U.S. Pat. No. 413,654. The time correction device according to DD 127 363 comprises a coupling pinion which, under the influence of the winding stem, can tilt about the axis thereof so as to be in contact either with the winding-mechanism wheel or with the time-setting wheel. Due to the fact that the coupling pinion is mounted on a pivoting lever in a cage, it is oriented substantially vertically relative to the winding-mechanism wheel and the time-setting wheel, which directly implies a significant bulk in the height direction. The mechanism is thus unsuitable for integration in extra-flat movements. In addition, this coupling, respectively the corresponding correction device, can only control two functions and therefore is not suitable for high-end timepieces having a number of functions. Document U.S. Pat. No. 413,654 describes a winding and time-setting system which comprises a coupling wheel adapted to tilt about a fixed axis of rotation. This coupling wheel makes it possible to transmit the movement of the winding stem either to the winding-setting wheel or to a wheel of the time-setting train, depending on the inclination of said coupling wheel, which is controlled by the winding stem with the aid of a ring mounted concentrically relative to the coupling wheel and comprising a lip for cooperating with the stem. Again, this device can only control two functions, and the operation of said device does not appear to be reliable, given that the inclined position of the coupling wheel, following the release of the coupling wheel, is not obtained by stress, but by the action of the force of gravity, which changes in accordance with the orientation of the corresponding timepiece.

The solutions of the prior art mentioned above have the common feature, apart from document DD 127 363, which proposes a rather particular arrangement having a coupling pinion mounted substantially vertically relative to the winding wheel and to the time-setting wheel, that the coupling pinion is arranged substantially in the plane of rotation of the entry wheel, for example the seconds wheel or the winding wheel, and the exit wheel, for example the chronograph wheel or the time-setting wheel. In spite of this layout the devices according to these documents do not lend themselves, for the reasons mentioned above, to integration in an extra-flat movement and are often affected by other disadvantages as explained above. Another type of devices according to the prior art is disclosed for example in documents FR 436 356, CH 2 547, EP 0 261 243, and EP 1 288 743. The common feature of these devices is that the entry wheel and the exit wheel are not arranged in the same plane of rotation, but in two different planes, such that the coupling pinion serving as a kinematic connection between these two wheels must be formed by a double pinion, of which one pinion cooperates with the entry wheel and the other pinion with the exit wheel.

For example, document FR 436 356 proposes a device having a double tilting pinion fixed to an inclinable axis perpendicular to the plane of rotation of the entry and exit wheels, arranged in two different planes, the inclination of the axis being caused by the displacement of a spring controlled by a movable part. The device clearly is not suitable for use in an extra-flat movement, and the control of said device does not appear to be very reliable. The document CH 2 547 also discloses a double tilting pinion fixed to an inclinable axis perpendicular to the distant parallel planes of rotation of the entry and exit wheels, the ends of the inclinable axis being fixed in a fork housed rotatably and perpendicularly relative to said axis. This system must have pinions of very small diameter in order to function, but also is unsuitable for integration in an extra-flat movement. Documents EP 0 261 243 and EP 1 288 743 also disclose a double tilting pinion fixed to an inclinable axis perpendicular to the distant planes of rotation of the entry and exit wheels, the inclination of the axis being caused in both cases by the displacement of a movable control member. The latter either carries, according to EP 0 261 243, an end of the inclinable axis, or constrains, according to EP 1 288 743, this end, otherwise mounted freely, by pressure. Similarly to the devices according to documents FR 436 356 and CH 2 547, these devices are not suitable for integration in an extra-flat movement, document EP 0 261 243 also specifying a condition on the minimal length of the inclinable axis so as to allow correct operation of the coupling. These devices in addition can only control a single function, which can be engaged or disengaged.

It must therefore be stated that, in spite of the significant number of pre-existing devices, the solutions of the prior art currently known for providing such a coupling, whether of the type having a coupling pinion in the same plane of rotation as the entry and exit wheels or of the type having a double coupling pinion on account of the distant planes of rotation of the entry and exit wheels, are not entirely satisfactory, are not suitable for certain applications, and cannot be used for any type of movements, in particular are not suitable for extra-flat movements.

SUMMARY OF THE INVENTION

The object of the present invention is therefore to overcome, at least in part, the drawbacks of the known devices and to provide a coupling device for timepieces that has a reduced bulk, in particular so as to allow integration in extra-flat movements, and which limits the problems of parasitic rotation at the moment of coupling. In addition, the device should lend itself to use within the scope of a number of horological applications, in particular for time-setting devices and chronograph watches, and should have a simple and robust structure, amongst others so as to ensure a reasonable production cost as well as reliable operation.

To this end, the present invention proposes a coupling device of the above-mentioned type, which is distinguished by the features specified in the claims. In particular, the coupling wheel of the device according to the present invention comprises an axis of rotation that can be inclined relative to the normal to said plane of rotation of the entry wheel and of the first exit wheel by being mounted pivotably at each of the ends thereof, at least one end of said axis of rotation being mounted on said movable element, and the ratio between the diameter of the coupling wheel and the height of the axis of rotation comprised between the intersection of said axis of rotation with said plane of rotation and the end mounted on the movable element being greater than 1.5:1.

As a result of these measures, the axis of rotation of the coupling wheel is constrained at two locations whist being inclinable. Thus, it is possible to arrange the coupling wheel in a tilting manner, enabling a coupling by tilting, which eliminates the parasitic rotation of the exit wheel affecting the conventional mechanisms, given that the coupling wheel engages with the exit wheel practically vertically and not radially. This is achieved whilst ensuring a construction using only a very limited number of parts and, in particular, whilst reducing the height of the device, given that the coupling, respectively the decoupling is formed primarily by providing the coupling wheel with a diameter that is sufficiently large to allow said coupling wheel to disengage from at least the first exit wheel. Thus, the device is very compact, such that it lends itself to integration in extra-flat movements and has simple and safe operation. The other end of said axis of rotation is preferably constrained by a fixed part of the frame of the timepiece, which consolidates the above-mentioned advantages.

In addition, the invention also relates to a time-setting device and a chronograph mechanism comprising such a coupling device. In fact, the latter is suitable for use in a number of horological applications and is thus highly versatile, both in terms of the layout and use thereof.

In an embodiment, a device of the invention comprises an entry wheel, a coupling wheel meshing with the entry wheel, and at least one first exit wheel, said coupling wheel being disposed in a manner substantially coplanar relative to the plane of rotation of the entry wheel and of the first exit wheel and being arranged such that it is adapted to tilt relative to said plane of rotation so as to be able to occupy at least a first coupling position in which the coupling wheel meshes with the first exit wheel and a second coupling position in which the coupling wheel is decoupled from the first exit wheel, the device comprising a movable element allowing to control the change of position between the first and the second position of the coupling wheel.

Further features and the corresponding advantages will become clear from the dependent claims and also from the description describing hereinafter the invention in greater detail.

BRIEF DESCRIPTION OF THE DRAWINGS

The accompanying drawings show schematically and by way of example a number of embodiments of the invention.

DETAILED DESCRIPTION OF THE INVENTION

The invention will now be described in detail with reference to the accompanying drawings illustrating by way of example a number of embodiments of the invention.

The present invention relates to a coupling device intended to be integrated in a timepiece, preferably in a wristwatch having a mechanical movement. For reasons of simplification of the language used, reference will be made hereinafter indifferently to "timepiece" and "watch", without limiting the scope of the corresponding explanations, which in all cases extend to any type of timepieces, having either a mechanical or electrical energy source. In addition, such a coupling device can be integrated in modules of such a timepiece, such as a time-setting device, a chronograph mechanism, a split-seconds mechanism, or other mechanisms adapted to be equipped with a coupling device according to the present invention. If the coupling device according to the present invention is described hereinafter by way of example in the context of applications of a time-setting device and a chronograph mechanism, this therefore does not limit the scope of protection for this invention, because an integration in other applications is possible by analogy. Due to the fact that a time-setting device and a chronograph mechanism, or other similar mechanisms suitable for combination with the coupling device according to the invention, are known per se to the person skilled in the art, the following description will be limited primarily and in so far as possible to the structure and to the operation of said coupling device.

In order to comment first on the structure and the components of a coupling device according to the present invention, reference is made to FIGS. 1*a* to 1*d* and 2*a* to 2*d*, which illustrate schematically and by way of example a first embodiment of such a device within the scope of the integration thereof in a time-setting device.

Figure 1A:
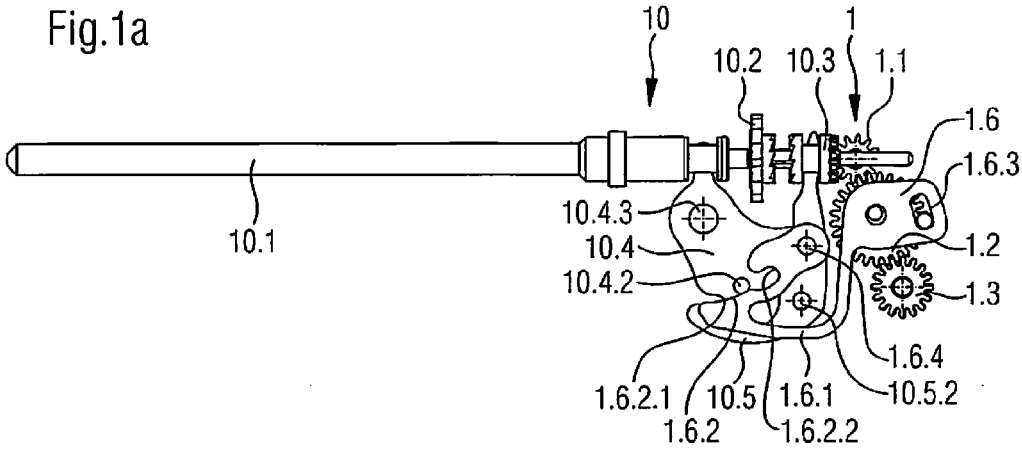
FIG. 1*a* shows a schematic plan view of a time-setting device comprising a first embodiment of a coupling device according to the present invention when the coupling device is in a first coupling position.
Figure 1B:
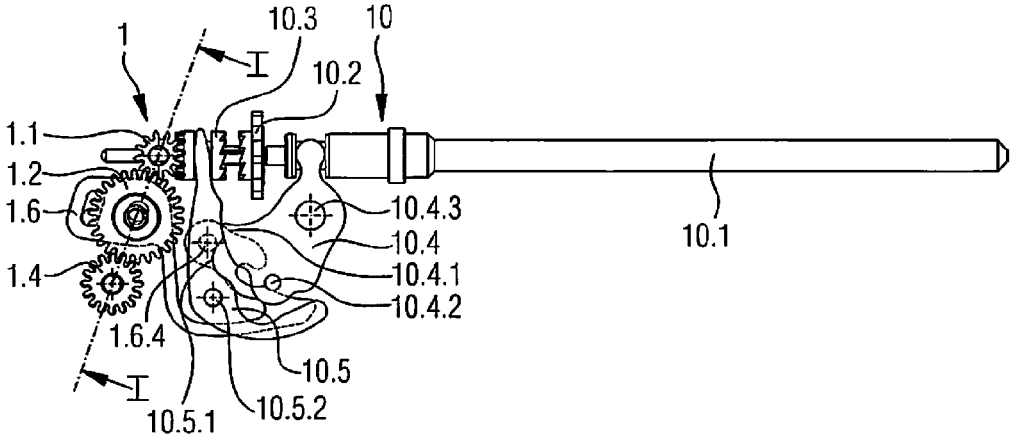
FIGS. 1*b* and 1*c* show a view from below and respectively a perspective view of this device in the same position.
Figure 1C:
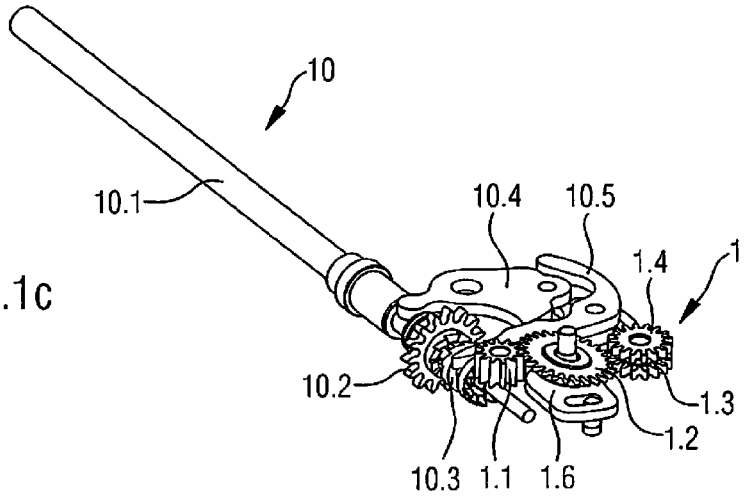
Figure 2A:
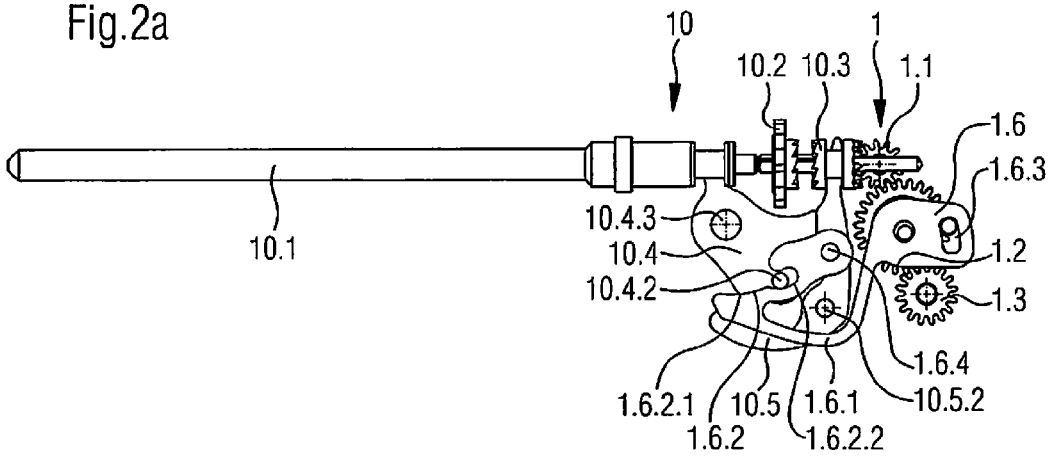
FIG. 2*a* shows a schematic plan view of the same time-setting device when the coupling device is in a second coupling position.
Figure 2B:
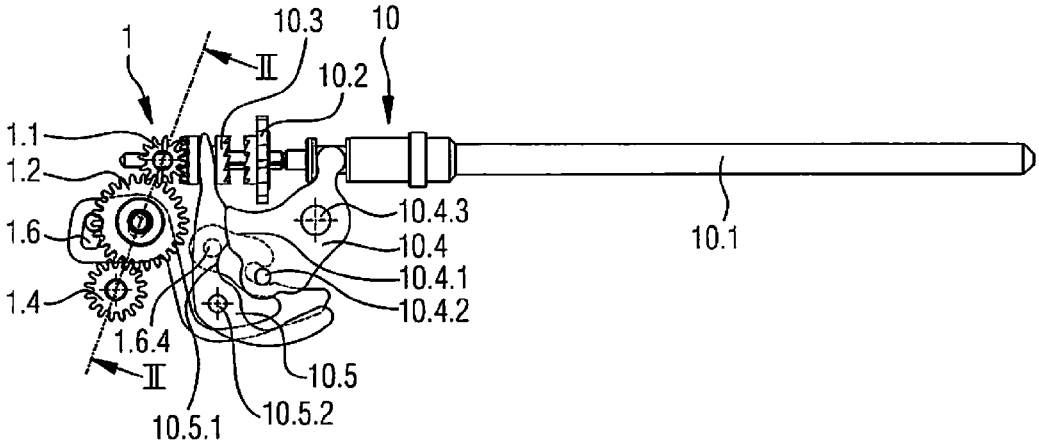
FIGS. 2*b* and 2*c* show a view from below and respectively a perspective view of this device in the same position.
Figure 2C:
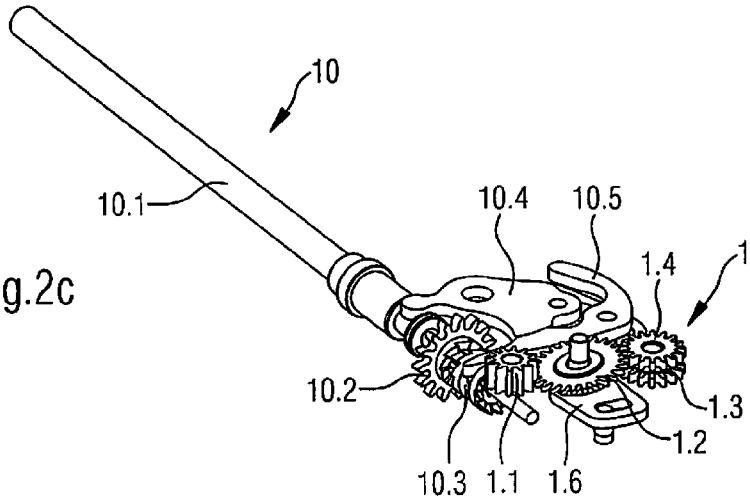

FIGS. 1*a*, 1*b*, and 1*c* are schematic views from above, from below, respectively in perspective of such a time-setting device when the coupling device according to the present invention integrated in this time-setting device is in a first coupling position, and FIGS. 2*a*, 2*b* and 2*c* show the time-setting device when the coupling device is in a second coupling position. It is clear that the time-setting device 10 comprises a winding stem 10.1. As in numerous devices of the prior art, the winding stem 10.1 can occupy at least three axial control positions. A winding pinion 10.2, of which the axial position relative to the frame of the timepiece is fixed, is mounted so to be freely rotatable about the winding stem 10.1, and a sliding pinion 10.3 is mounted slidingly on the winding stem 10.1. The winding pinion 10.2 comprises a radial toothing meshing with a train connected kinematically to the barrel of the movement of the corresponding timepiece and a Breguet toothing oriented in the direction of the sliding pinion 10.3, whereas the latter comprises a Breguet toothing that is oriented in the direction of the winding pinion 10.2 and a toothed crown that is oriented in the opposite direction. In addition, the sliding pinion 10.3 is rotatably connected to the winding stem 10.1, for example by a section of specific form over a portion of the length of the stem 10.2 and an opening of corresponding form in the sliding pinion 10.3, and is adapted to mesh with said winding pinion 10.2 when the winding stem 10.1 is in the first axial control position thereof, which normally corresponds to the winding position of the barrel of the corresponding timepiece. The time-setting device 10 also comprises a setting and correction wheel 1.1, which can be fixed on a bar of the corresponding timepiece and forms an entry wheel. This setting and correction wheel 1.1 is adapted to mesh with said toothed crown of the sliding pinion 10.3 when the winding stem 10.1 is in the second or third axial control position thereof.

In addition, the time-setting device 10 comprises a pull-out piece 10.4 controlled by the winding stem 10.1 and allowing to displace, by means of a control lever 10.5 also referred to as a sliding pinion yoke, the sliding pinion 10.3 between a first winding position in which the sliding pinion 10.3 meshes with said winding pinion 10.2, when the winding stem 10.1 is in the first axial control position thereof, and a second correction position in which the toothed crown of the sliding pinion 10.3 meshes with said setting and correction wheel 1.1, when the winding stem 10.1 is in the second or third axial control position thereof. In fact, the pull-out piece 10.4 is pivotable about an axis of the pull-out piece 10.4.3 and cooperates via one of the ends thereof with the winding stem 10.1, for example by being engaged with a groove of the winding stem 10.1, whereas the other of the ends of said pull-out piece comprises a point 10.4.1 and a pin 10.4.2. This is also visible in FIG. 1*b*, which also shows that the point 10.4.1 of the pull-out piece 10.4 cooperates with a lateral portion 10.5.1 of said control lever 10.5, which is mounted pivotably about a pivot axis 10.5.2. When the point 10.4.1 of the pull-out piece 10.4 is positioned opposite a hollow on the lateral portion 10.5.1 of the control lever 10.5, the sliding pinion 10.3 is in the first winding position thereof (not illustrated in the figures), respectively the winding stem 10.1 is in the first axial control position thereof, in which the sliding pinion 10.3 meshes with said winding pinion 10.2 so as to allow the winding of the barrel of the timepiece. When the point 10.4.1 of the pull-out piece 10.4 is positioned outside said hollow, over a portion having a substantially circular front face on the lateral portion 10.5.1 of the control lever 10.5, the sliding pinion 10.3 is in the second, correction position thereof, which is illustrated in FIGS. 1*a* to 1*c* and 2*a* to 2*c*, in which the sliding pinion 10.3 meshes with the toothed crown of said setting and correction wheel 1.1 serving as entry wheel. This may correspond either to the second axial control position of the winding stem 10.1 or to the third axial control position of the winding stem 10.1 so as to allow the implementation of the corresponding functions.

To this end the device also comprises a first correction wheel 1.3 forming a first exit wheel, which is adapted to be kinematically connected to said setting and correction wheel 1.1 when the winding stem 10.1 is in the second axial control position thereof, and a second correction wheel 1.4 forming a second exit wheel, which is adapted to be kinematically connected to the setting and correction wheel 1.1 when the winding stem is in the third axial position thereof. The second correction wheel 1.4 is arranged on the same axis as the first correction wheel 1.3, but the two wheels 1.3, 1.4 are not integral with one another, so as to each be adapted to perform an independent rotation. The functions attributed to the first 1.3 and second correction wheel 1.4 can in principle be selected freely, and for example may consist in the correction of the date and in the setting of the time, or vice versa.

The time-setting device 10 is distinguished from the prior art devices, amongst others, by the fact that it comprises a coupling device 1 provided with a specific layout as described hereinafter. Generally, this coupling device 1 comprises an entry wheel 1.1, corresponding to the above-mentioned setting and correction wheel, a coupling wheel 1.2 normally meshing permanently with this entry wheel 1.1, and at least one first exit wheel 1.3, corresponding to the above-mentioned first correction wheel. Said coupling wheel 1.2 is disposed in a manner substantially coplanar relative to the plane of rotation p of the entry wheel 1.1 and of the first exit wheel 1.3, these two latter components being arranged effectively in a common plane of rotation. In addition, the coupling wheel 1.2 is arranged such that it is adapted to tilt relative to said plane of rotation so as to be adapted to occupy at least one first coupling position in which the coupling wheel 1.2 meshes with the first exit wheel 1.3 and a second coupling position in which the coupling wheel 1.2 is decoupled from the first exit wheel 1.3. The centers of the entry wheel 1.1, of the coupling wheel 1.2, and of the first exit wheel 1.3 are preferably aligned, but may also form a different angle, in particular a right angle.

Figure 1D:
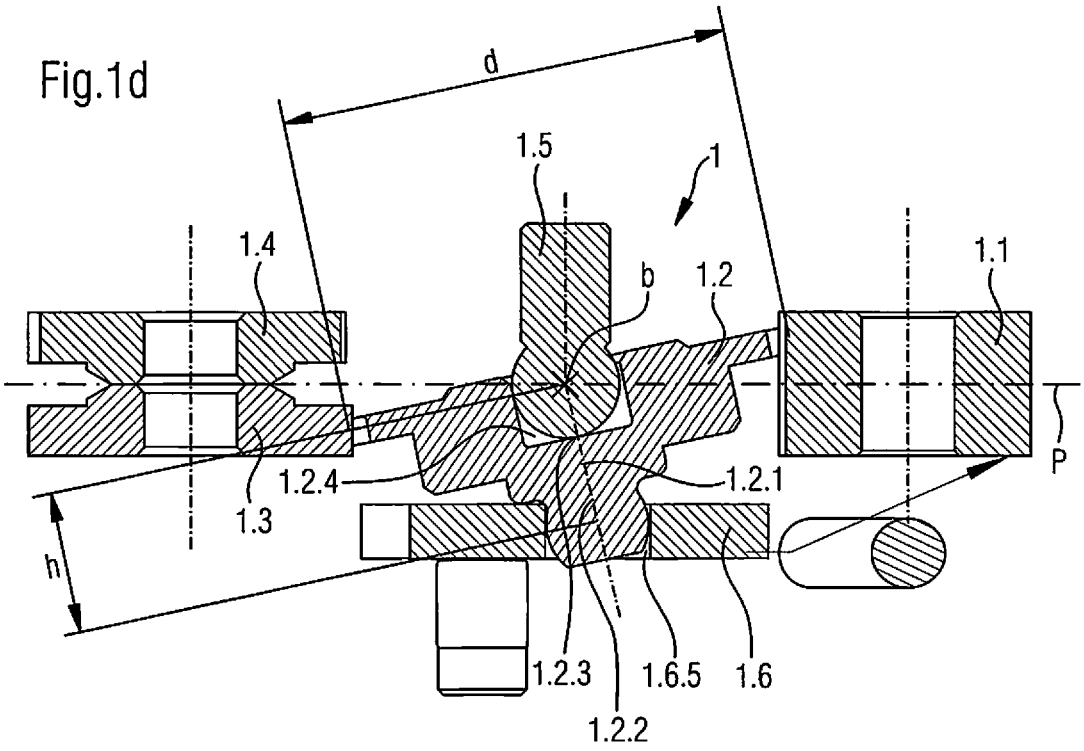
FIG. 1*d* is a longitudinal section of this device along the line I-I indicated in FIG. 1*b*.
Figure 2D:
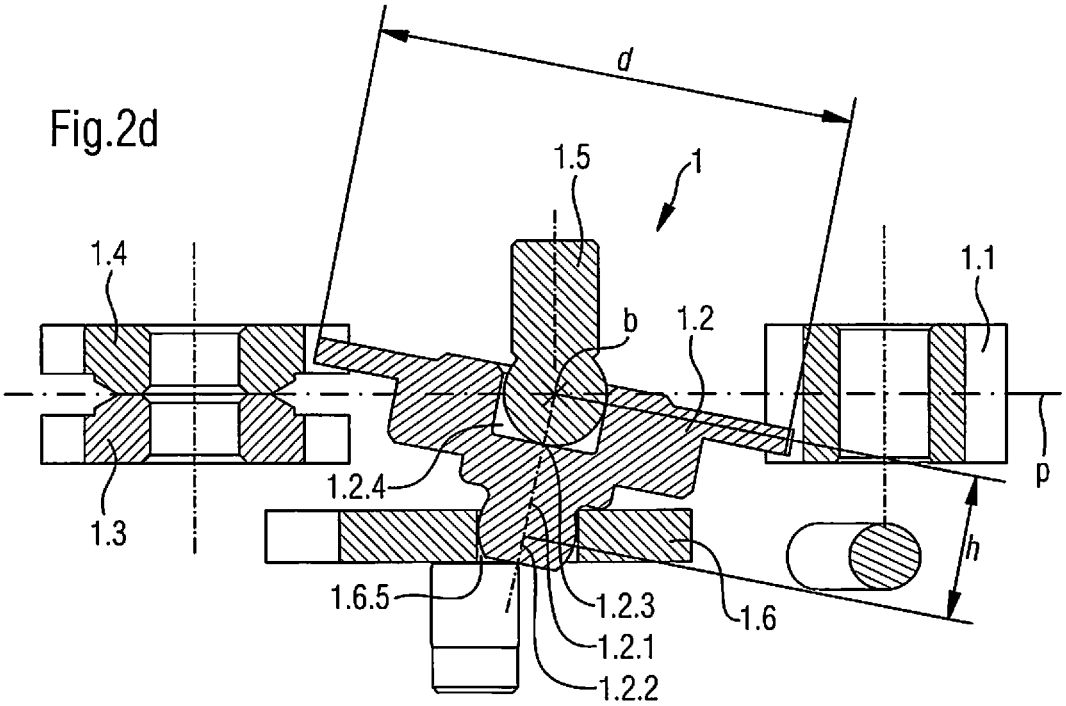
FIG. 2*d* is a longitudinal section of this device along the line II-II indicated in FIG. 2*b*.

In particular, said coupling wheel 1.2 comprises, by contrast with the prior art devices, an axis of rotation 1.2.1 that can be inclined relative to the normal to said plane of rotation p of the entry wheel 1.1 and of the first exit wheel 1.3, thanks to a specific layout. The inclination of said axis of rotation 1.2.1 of the coupling wheel 1.2 is possible due to the fact that this axis 1.2.1 is mounted pivotably at each of the ends thereof 1.2.2, 1.2.3, of which at least one end 1.2.2 is mounted on a movable element 1.6. This movable element 1.6 allows to control the change of position between the first and the second coupling position of the coupling wheel 1.2, therefore to implement the coupling, respectively the decoupling between the coupling wheel 1.2 and the first exit wheel 1.3. This is illustrated for example in FIGS. 1*d* and 2*d* and will be described in greater detail hereinafter. Generally, it is also noted here that the other end 1.2.3 of said axis of rotation 1.2.1 is normally tensioned by a fixed part 1.5 of the frame of the timepiece. In addition, the ratio d:h between the diameter d of the coupling wheel 1.2 and the height h of the axis of rotation 1.2.1 comprised between the intersection of said axis of rotation with said plane of rotation p and the end mounted on the movable element 1.6, as illustrated schematically in FIGS. 1*d* and 2*d*, is greater than a value of approximately 1.5:1. The low height of the coupling device, therefore primarily the low effective height h of the axis 1.2.1 of the coupling wheel 1.2 relative to the diameter d of this wheel 1.2 makes it possible to provide a coupling, respectively decoupling between the coupling wheel 1.2 and the first exit wheel 1.3 in a very reduced space, which is optimised in view of the needs of an extra-flat watchmaking movement.

Given that the coupling of the coupling wheel 1.2 and of the first exit wheel 1.3 is performed by tilting, that is to say by successive engagement of the respective toothings of said wheels in a direction oriented substantially perpendicularly to the plane of rotation p, and not radially, it may be that a tooth of the coupling wheel 1.2 falls from above onto a tooth of the first exit wheel 1.3. In order to allow, pending a rotation of the winding stem 10.1, a gentle engagement in this case as well, the movable element 1.6 comprises, preferably and as can be seen for example in FIG. 1*a*, a resilient arm 1.6.1 allowing to absorb the necessary corresponding offset at the coupling wheel 1.2. The movable element 1.6, which is mounted pivotably about a pivot axis 1.6.4, also comprises a guide means 1.6.3 limiting the movement of said movable element 1.6 and defining the maximum tilt thereof in the first and second coupling position, respectively in general in the extreme positions of the displacement of the coupling wheel 1.2. At the same time, this defines the maximum positions of inclination of the axis of rotation 1.2.1 of the coupling wheel 1.2. The guide means 1.6.3 can be formed by an elongated opening in cooperation with a pin, as is illustrated for example in FIGS. 1*a* to 1*c*, by two horns in cooperation with a pin, by a protruding portion in cooperation with two pins, or by other equivalent means.

In addition, the entry wheel 1.1 of a coupling device 1 according to the present invention has, preferably, a greater thickness, equivalent substantially to a multiple of the thickness of said at least one first exit wheel 1.3, as illustrated beside others in FIGS. 1*d* and 2*d*. Consequently, the coupling device 1 may comprise, generally, at least one second exit wheel 1.4, such as the second correction wheel of the time-setting device 10 mentioned above, or even three or more exit wheels, if the coupling wheel 1.2, respectively the axis of rotation 1.2.1 thereof, and the movable element 1.6 have three or more positions of inclination, respectively three or more stable tilt positions. For example, in the case of three exit wheels, it is sufficient to add a third exit wheel between the first and second exit wheel illustrated in FIGS. 1*d* and 2*d* and to define, besides the two stable inclined positions of the coupling wheel 1.2, a third stable position in which the coupling wheel 1.2 is coplanar with said third exit wheel. It is, however, not necessary for the coupling device 1 according to the present invention to have more than one exit wheel, the number of said wheels being dependent in fact on the type of application for which the coupling device 1 is intended. It is in particular the ratio d:h between the diameter d of the coupling wheel 1.2 and the effective height h of the axis of rotation 1.2.1 thereof, selected in a device according to the invention differently as compared to the prior art, which opens the possibility of integrating a number of functions in this type of device. The large diameter d of the coupling wheel 1.2 relative to the effective height h of the axis thereof thus allows to provide a coupling having multiple functions, by contrast in particular with the type of prior art mentioned above using a double coupling pinion.

Returning to the time-setting device 10 illustrated in FIGS. 1*a* to 1*c* and 2*a* to 2*c*, in which the coupling device 1 is equipped with two exit wheels, it is noted that, in the case of application of the coupling device 1 described above in general, said movable element is formed by a coupling yoke 1.6, which cooperates with said pull-out piece 10.4 so as to control the change of position between the first and the second coupling position of the coupling wheel 1.2. The latter meshes with the first correction wheel 1.3 in the first coupling position thereof and with the second correction wheel 1.4 in the second coupling position thereof, the coupling wheel 1.2 being decoupled from the first correction wheel 1.3 in this second position of the coupling device. In order to obtain the change of position between the first and the second coupling position of the coupling wheel 1.2, said coupling yoke 1.6 comprises a control portion 1.6.2 adapted to cooperate with the pin 10.4.2 on the pull-out piece 10.4, against which the control portion 1.6.2 is prestressed, for example by a prestressing spring, such that the coupling yoke 1.6 can occupy a first and a second tilt position, in which the coupling wheel 1.2 is in the first, respectively second coupling position thereof. Said control portion 1.6.2 preferably comprises a first section in the form of an arc of a circle 1.6.2.1 and a second section in the form of an offset arc of a circle 1.6.2.2, which correspond to the first and second tilt position of the coupling yoke 1.6. Instead of being formed by a surface of specific form, the control portion 1.6.2 can also be formed by an opening of corresponding form in the coupling yoke 1.6. It is also possible to reverse the design, that is to say to provide a pin on the coupling yoke 1.6 and a corresponding control portion on the pull-out piece 10.4.

In this case of integration of the coupling device 1 in a time-setting device 10, the first correction wheel 1.3 consists, preferably, of the fast correction wheel of the date, but may also be the hour fast correction wheel, or a another similar correction wheel. The second correction wheel 1.4 is, preferably, the normal time-setting wheel, but in this case as well it may be another wheel.

The previous explanations concerning the structure and the components of a coupling device 1 according to the present invention and application thereof in a time-setting device 10 allow one to easily understand the operation thereof, in particular with the aid of the series of FIGS. 1*a* to 1*d* and 2*a* to 2*d*. In fact, when the crown fixed on the outer end of the winding stem 10.1 is in the pushed position thereof, the winding stem 10.1 is in the first axial control position thereof (not illustrated in the figures). In this case the point 10.4.1 of the pull-out piece 10.4 enters the hollow on the lateral portion 10.5.1 of the control lever 10.5 and the sliding pinion 10.3 is in the first winding position thereof, in which the Breguet toothing of the sliding pinion 10.3 meshes with the Breguet toothing of the winding pinion 10.2, by being decoupled from the setting and correction wheel 1.1, so as to allow the winding of the barrel of the corresponding timepiece. In this position the coupling wheel 1.2 meshes with the first exit wheel 1.3, which in the example above is the date fast correction wheel, as illustrated in FIG. 1*d*, and is decoupled from the second exit wheel 1.4, which in the example above is the time-setting wheel. However, this is of no consequence for these wheels and the trains kinematically connected thereto, since the sliding pinion 10.3, respectively the winding stem 10.1 and therefore the crown is not kinematically connected to the setting and correction wheel 1.1.

When the user of this timepiece pulls the crown into the first pulled position thereof, he brings the winding stem 10.1 into the second axial control position thereof. This gently pivots the pull-out piece 10.4, such that the point thereof 10.4.1 leaves said hollow on the lateral portion 10.5.1 of the control lever 10.5 and presses against the portion having a substantially circular front face on the lateral portion 10.5.1 of the control lever 10.5, as can be seen for example in FIG. 1*b*. Consequently, the sliding pinion 10.3 slides into the second correction position thereof, which is illustrated in FIGS. 1*a* to 1*c*, in which the toothed crown of the sliding pinion 10.3 meshes with said setting and correction wheel 1.1 and is decoupled from the winding pinion 10.2. At the same time the pin 10.4.2 on the pull-out piece 10.4 slides along the first section in the form of an arc of a circle 1.6.2.1 of the control portion 1.6.2 of the coupling yoke 1.6, but remains, as in the pushed position of the crown, on said first section 1.6.2.1, such that the coupling wheel 1.2 still meshes with the first exit wheel 1.3, i.e. the date fast correction wheel, and is decoupled from the second exit wheel 1.4, i.e., the time-setting wheel, as illustrated in FIG. 1*d*. The user can thus quickly correct the date or can perform any other function attributed to the first exit wheel 1.3.

When the user of this timepiece then pulls the crown into the second pulled position thereof, he brings the winding stem 10.1 into the third axial control position thereof. This pivots the pull-out piece 10.4 slightly further still, as can be seen for example in FIG. 2*b*, but the point thereof 10.4.1 remains pressed against the portion having a substantially circular front face on the lateral portion 10.5.1 of the control lever 10.5. The sliding pinion 10.3 thus remains in the second correction position thereof, in which the sliding pinion 10.3 meshes with said setting and correction wheel 1.1 and is decoupled from the winding pinion 10.2, which is also illustrated in FIGS. 2*a* to 2*c*. The sliding pinion 10.3 thus remains in the same position in the second and third axial control position of the winding stem 10.1. At the same time, the pin 10.4.2 on the pull-out piece 10.4 slides further along the control portion 1.6.2 of the coupling yoke 1.6 and engages with the second section in the form of an offset arc of a circle 1.6.2.2. This causes a movement of the coupling yoke 1.6, which produces an inclination of the axis of rotation 1.2.1 of the coupling wheel 1.2, such that the coupling wheel 1.2 tilts and meshes with the second exit wheel 1.4, i.e., the time-setting wheel, whilst decoupling from the first exit wheel 1.3, i.e., the date fast correction wheel. In this position, which is illustrated schematically in FIG. 2*d*, the user can thus set the time or perform any other function attributed to the second exit wheel 1.4.

As mentioned above, the coupling wheel 1.2 of a coupling device 1 according to the present invention has an axis of rotation 1.2.1 inclinable relative to the normal of the plane of rotation p of the entry wheel 1.1 and of the first 1.3, respectively of the second exit wheel 1.4. As can be seen in FIGS. 1*d* and 2*d*, the inclination of this axis of rotation 1.2.1 of the coupling wheel 1.2 is performed by making the ends 1.2.2, 1.2.3 of the axis 1.2.1 pivotable and by positioning at least one end 1.2.2 of this axis 1.2.1 on said movable element 1.6, which then allows to control the change of position between the coupling positions of the coupling wheel 1.2, therefore to perform the coupling and the decoupling of the corresponding wheels. It should be noted in this context that the other end 1.2.3 of said axis of rotation 1.2.1 is normally constrained by a fixed part 1.5 of the frame of the timepiece, for example by an end in the form of a ball joint of a post 1.5 fixed to a bar of the timepiece, as also visible in FIGS. 1*d* and 2*d*. However, it is possible in theory to also place this end 1.2.3 of said axis of rotation 1.2.1 on a second movable element, in particular a movable element performing an equivalent movement in the direction opposite the movement of the movable element 1.6 so as to reduce the change of position of the center of the coupling wheel 1.2. However, this is normally not necessary, due to the fact that this change can be absorbed by the play between the teeth of the corresponding wheels.

In addition, in the example illustrated in FIGS. 1*d* and 2*d*, the first end 1.2.2 of the axis of rotation 1.2.1 of the coupling wheel 1.2 oriented toward the movable element 1.6 is equipped with a rounded portion, similar to a ball joint, which is housed in a corresponding seat 1.6.5 provided on the movable element 1.6. Likewise, said end in the form of a ball joint of the post 1.5 is housed in a cavity 1.2.4 formed in the coupling wheel 1.2 on the side thereof oriented toward said post 1.5, said cavity surrounding the tilt point b of the coupling wheel 1.2. Generally, and as illustrated schematically in FIGS. 1*d* and 2*d*, in a device according to the present invention, said tilt point b of the axis 1.2.1 of the coupling wheel 1.2 is advantageously arranged in the common plane of rotation p of the entry wheel 1.1 and of the first exit wheel 1.3, or at least close to the quasi common plane of rotation p of the entry wheel 1.1, of the first exit wheel 1.3, and of the second exit wheel 1.4, in which plane the coupling wheel 1.2 is also arranged in the case in which there are a number of exit wheels 1.3, 1.4. In fact, the tilt point h is formed by the intersection of the axis of rotation 1.2.1 and of the tilt axis of the coupling wheel 1.2, and the positioning thereof in said plane of rotation p allows a particularly favourable layout for integration of a coupling device in an extra-flat watchmaking movement. The cooperation between said rounded portion on the end 1.2.2 of the axis of rotation 1.2.1 and said seat on the movable element 1.6, as well as the cooperation between the end in the form of a ball joint of the post 1.5 and the cavity 1.2.4 in the coupling wheel 1.2 thus each provide a joint, similar to the hip joint, each comprising a male portion and a female portion. In a variant, the first end 1.2.2 of the axis of rotation 1.2.1 of the coupling wheel 1.2 can be equipped with a straight portion, which is housed in a corresponding seat provided on the movable element 1.6 in which, preferably, a stone having an opening of diameter slightly greater than said straight part is driven so as to reduce the frictional forces between the straight part and seat thereof.

Figure 3A:
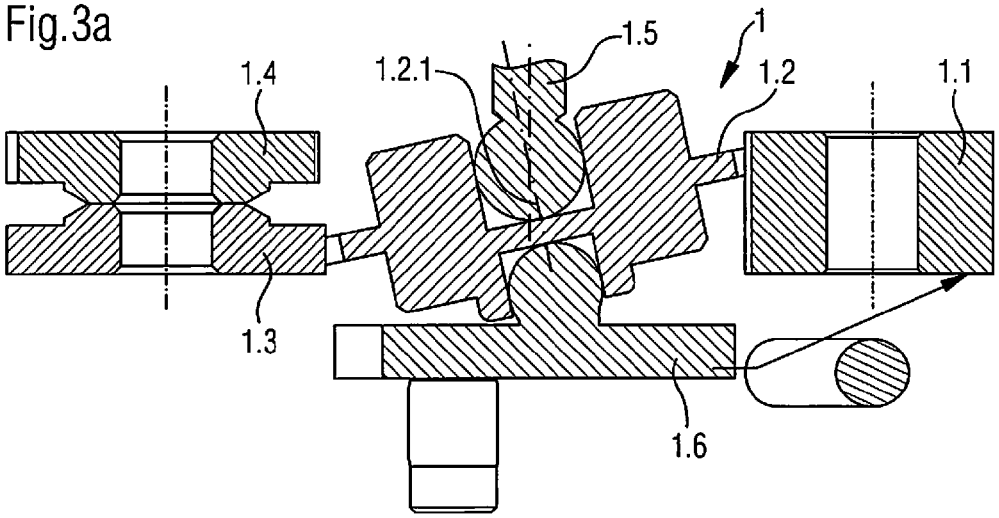
FIGS. 3*a*, 3*b*, and 3*c* show, by longitudinal sections through a coupling device according to the present invention similar to FIG. 1*b*, further embodiments of a coupling device according to the present invention, in particular with regard to the mounting of the axis of rotation of the coupling wheel such that this axis can be inclined by being mounted pivotably at each of the ends thereof and at least one end of said axis of rotation being mounted on a movable element.
Figure 3B:
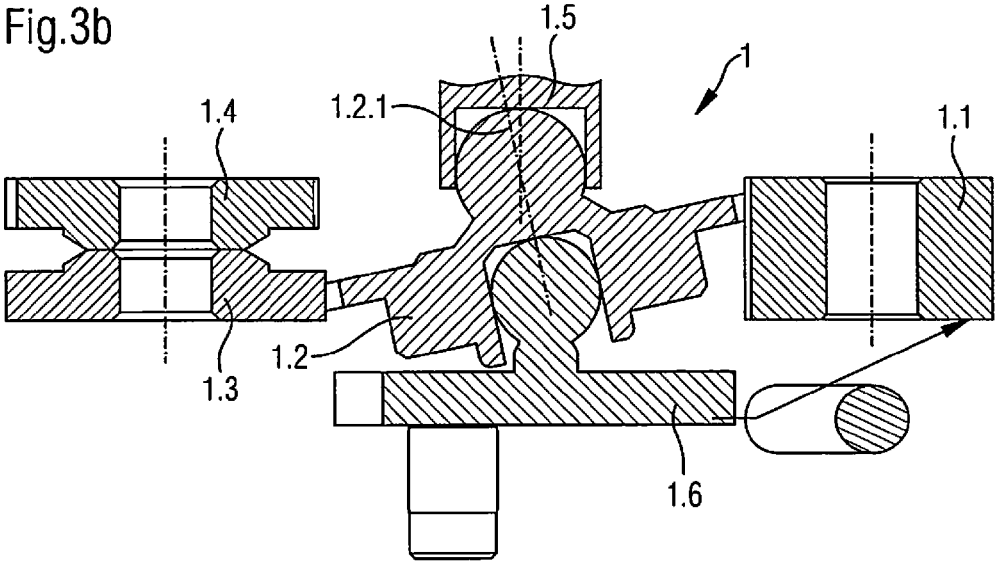
Figure 3C:
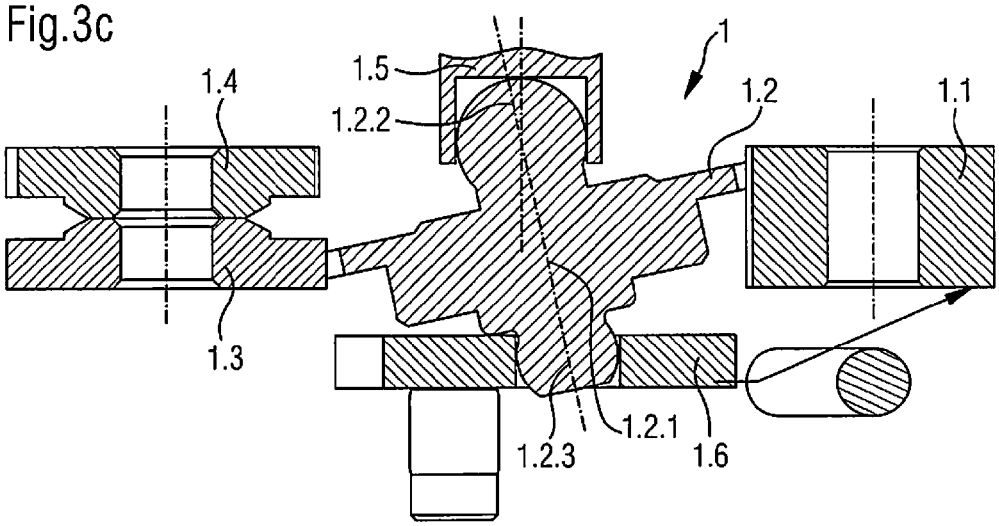
Figure 4A:
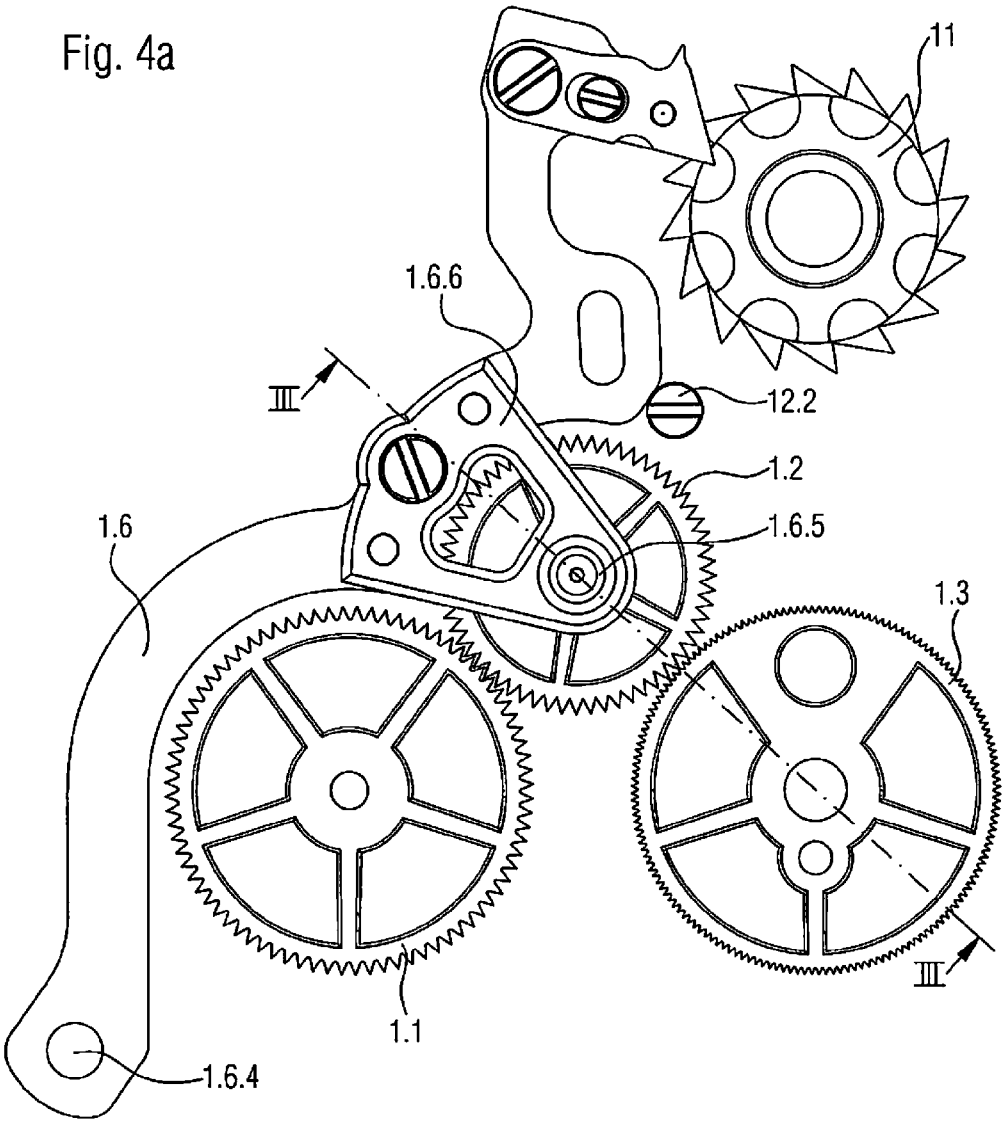
FIG. 4*a* shows a schematic plan view of a chronograph mechanism comprising a second embodiment of a coupling device according to the present invention when the coupling device is in a first coupling position.
Figure 4B:
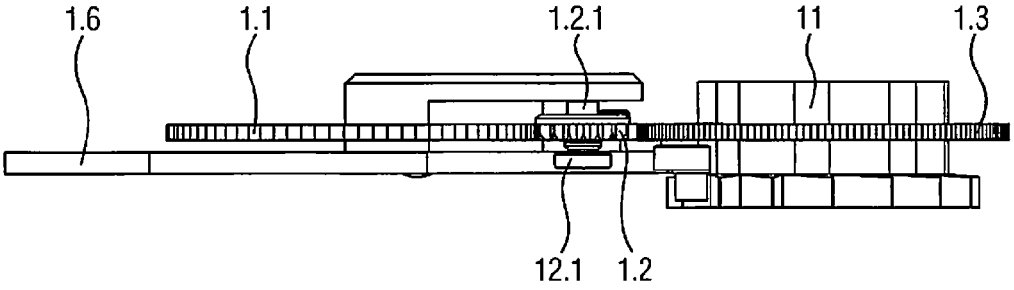
FIGS. 4*b* and 4*c* show a side view and respectively a perspective view of this mechanism in the same position.
Figure 4C:
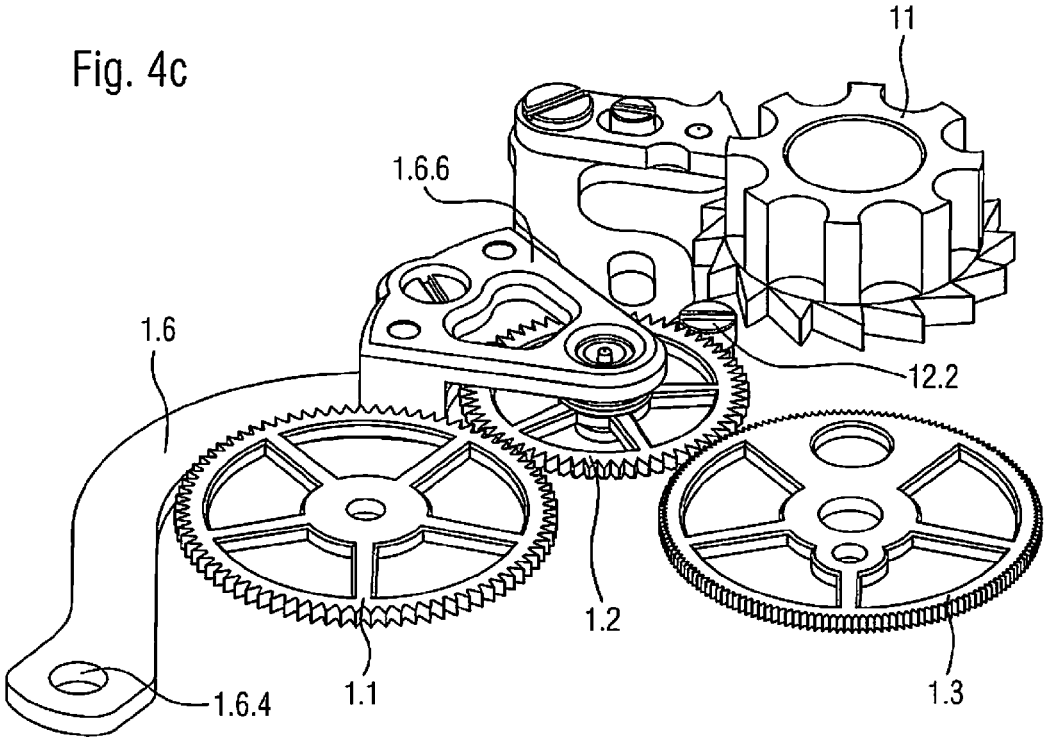
Figure 4D:
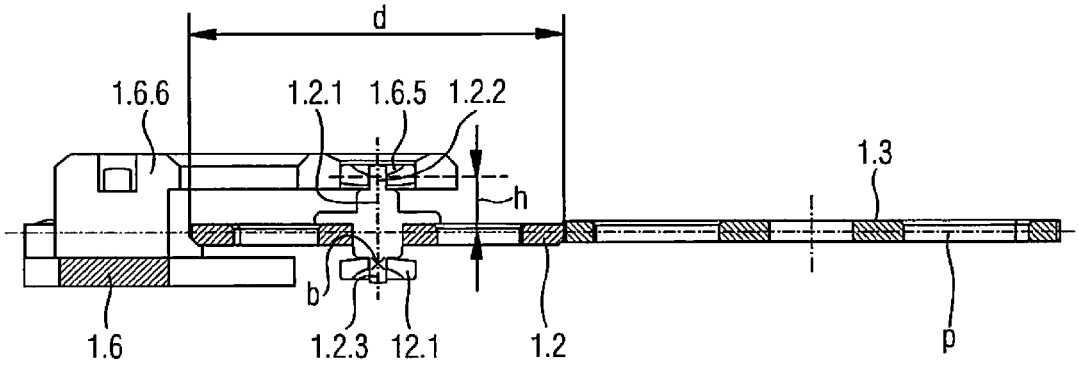
FIG. 4*d* is a longitudinal section of this mechanism along the line indicated in FIG. 4*a*.
Figure 5A:
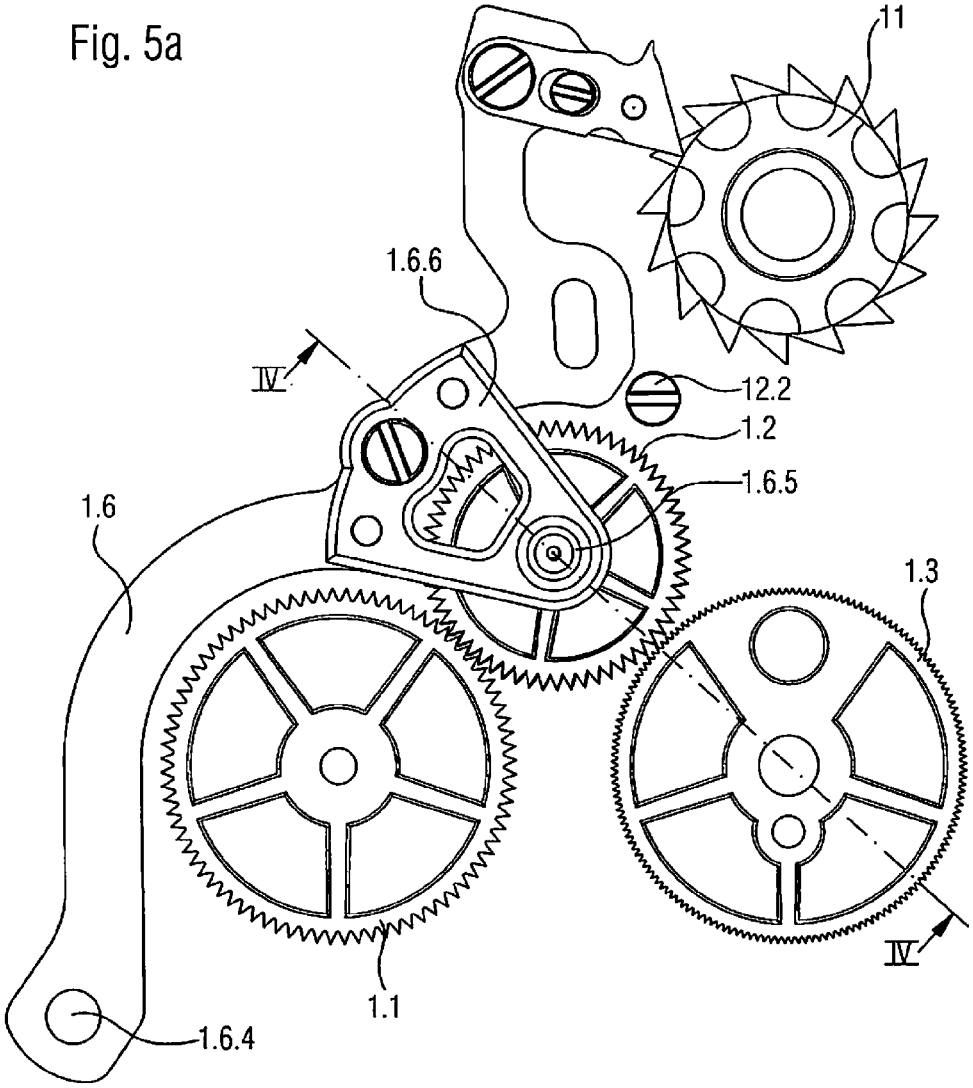
FIG. 5*a* shows a schematic plan view of the same chronograph mechanism when the coupling device is in a second coupling position.
Figure 5B:
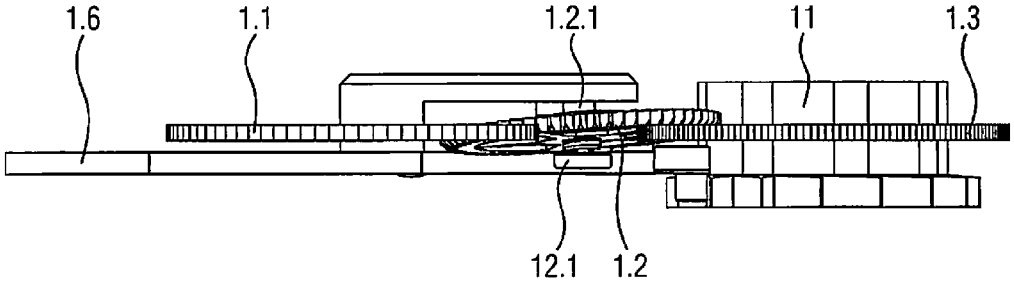
FIGS. 5*b* and 5*c* show a side view and respectively a perspective view of this mechanism in the same position.
Figure 5C:
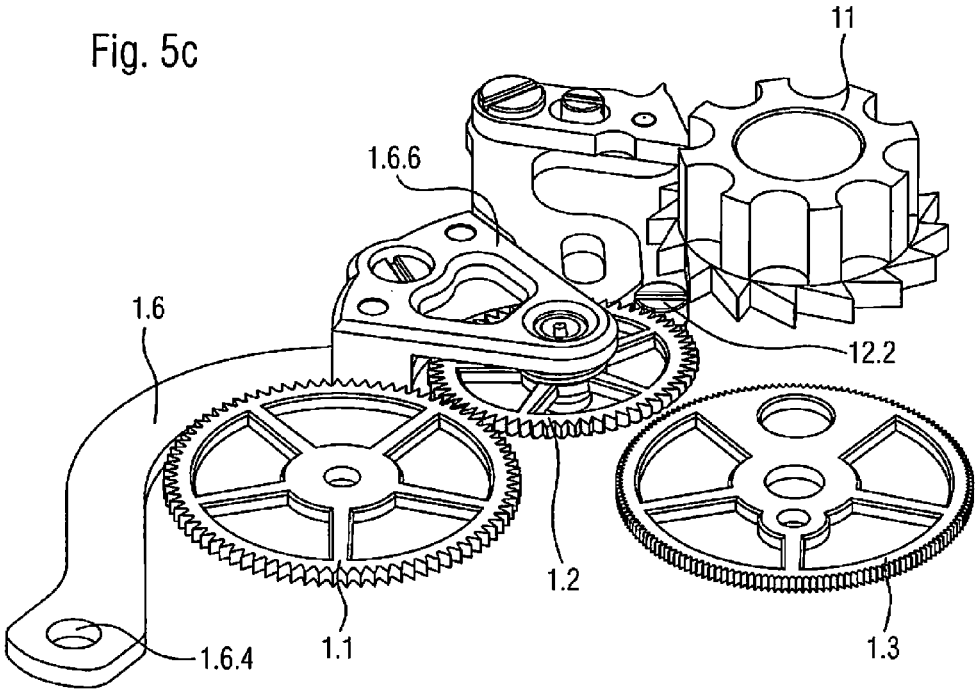
Figure 5D:
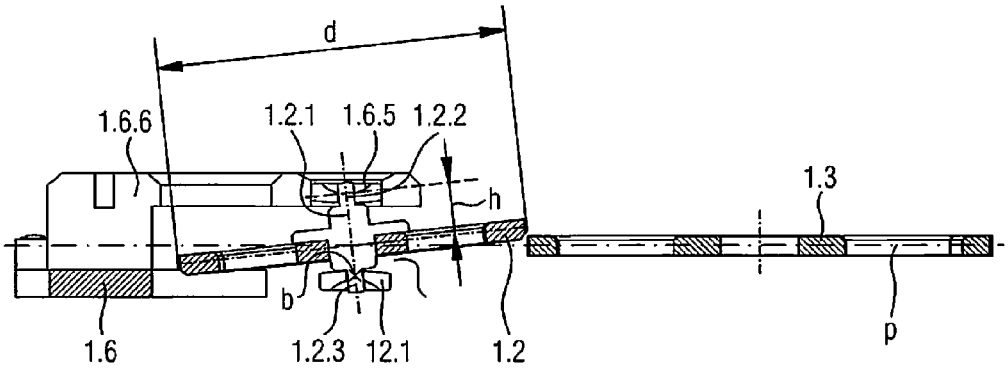
FIG. 5*d* is a longitudinal section of this mechanism along the line IV-IV indicated in FIG. 5*a*.

FIGS. 3*a* to 3*c* show, by longitudinal sections similar to FIG. 1*d*, other embodiments of a coupling device according to the present invention, in particular with regard to the mounting of the axis of rotation 1.2.1 of the coupling wheel 1.2 such that this can be inclined. In fact, the joints at the first end 1.2.2 and at the second end 1.2.3 of the axis of rotation 1.2.1 of the coupling wheel 1.2 can, in principle, also be formed by reversing the male and female portions at the ends 1.2.2, 1.2.3. For example, FIG. 3*a* shows the design with two female portions on the coupling wheel 1.2, the male portions being arranged on the post 1.5 and the movable element 1.6. FIG. 3*b* shows the design with a female portion on the side of the coupling wheel 1.2 oriented toward the movable element 1.6, which comprises a corresponding male portion, and a male portion placed on the side of the coupling wheel 1.2 oriented toward the post 1.5, which in turn comprises a corresponding female portion. This corresponds to a configuration that is the reverse of that of FIGS. 1*d* and 2*d*. Lastly, FIG. 3*c* shows the design with two male portions on the coupling wheel 1.2, the female portions being arranged on the post 1.5 and the movable element 1.6. It is also possible to provide these joints by other equivalent means, without the need to list all of these here. However, the configurations of FIGS. 1*d* and 2*d*, or of FIG. 3*a* are preferred embodiments because they make it possible to better place the tilt point b of the axis 1.2.1 of the coupling wheel 1.2 in a fixed manner in the common plane of rotation p of the entry wheel 1.1 and of the first exit wheel 1.3. In this case, the post 1.5, via the end thereof in the form of a ball joint, forms the pivot point b of the axis of rotation 1.2.1 of the coupling wheel 1.2, and this axis of rotation 1.2.1 can be formed physically by an axis 1.2.1 about which the coupling wheel 1.2 turns, as in the preferred embodiment illustrated in FIGS. 1*d* and 2*d*, or can have only the form of a basic axis, as in the embodiment illustrated in FIG. 3*a*.

A second embodiment of a coupling device according to the present invention, integrated in this case by way of example in a chronograph mechanism, is illustrated schematically in FIGS. 4*a* to 4*d* and 5*a* to 5*d*, which show a view from above, a view from the side, a perspective view and a longitudinal section of the chronograph mechanism in two different positions, i.e. when the chronograph is activated and when it is stopped. Although the other elements of this second embodiment of the coupling device, apart from a different form or placement without this resulting in a substantial difference, are identical compared with the device according to the first embodiment, the coupling device 1 in this application has only a single exit wheel 1.3. In addition, the movable element also provided in the form of a coupling yoke 1.6 here has a substantially different layout, which, however, does not change the function thereof.

In fact, the chronograph mechanism comprises a seconds wheel 1.1, which in this application forms the entry wheel of the coupling device according to this embodiment and which is driven by a geartrain of the movement of the corresponding chronograph watch. It also comprises a chronograph wheel 1.3 forming an exit wheel of the coupling device and carrying a seconds hand of the chronograph. Alternatively, the latter can also be placed on another wheel kinematically connected to the chronograph wheel. A minutes hand of the chronograph mounted on a minutes wheel of the chronograph, which is kinematically connected to the chronograph wheel 1.3, is not illustrated in the figures because this general design is well known to the person skilled in the art. The chronograph mechanism lastly comprises a coupling wheel 1.2 disposed between the seconds wheel 1.1 and the chronograph wheel 1.3. In the example illustrated in the figures, the centers of the seconds wheel 1.1, of the coupling wheel 1.2, and of the chronograph wheel 1.3 form a right angle, but could also be aligned or could form another angle, depending on the construction of the movement in which the mechanism is to be integrated. This is also dependent on the form of the coupling yoke 1.6 serving as a movable element of the coupling device and which has, in the example illustrated in FIGS. 4*a* to 4*d* and 5*a* to 5*d*, an elongate form on the whole having two concave portions so as to avoid any contact with the periphery of the seconds wheel 1.1 and of the coupling wheel 1.2. Lastly, the chronograph mechanism comprises a control means allowing to start and stop the measurement of a measured time, provided in the example illustrated by a column wheel 11. This control means could be provided by any other equivalent means known to the person skilled in the art and serves to control the angular displacements of the coupling yoke 1.6. The latter is mounted so as to be pivotable at one of the ends thereof about the pivot axis 1.6.4, whereas the other of the ends thereof is free and cooperates, preferably with the aid of a pallet-stone mounted on the free end, with the periphery of said column wheel 11. The angular displacement of the coupling yoke 1.6 in the direction of the chronograph wheel 1.3 is limited by a pin 12.2 fixed on the frame of the timepiece, and the displacement of said yoke in the reverse direction could be limited in a similar manner.

Similarly to the first embodiment, the movable element provided in the form of the coupling yoke 1.6 in accordance with the second embodiment carries the first end 1.2.2 of the axis of rotation 1.2.1 of the coupling wheel 1.2, moreover with the aid of a bar 1.6.6 mounted on the coupling yoke 1.6, which comprises a corresponding seat 1.6.5. The second end 1.2.3 of this axis 1.2.1 is housed in a portion 12.1 of the frame of the timepiece, similarly to the first embodiment. By contrast with the first embodiment, the axis of rotation 1.2.1 of the coupling wheel 1.2 in accordance with the second embodiment of a coupling device according to the present invention, in the example illustrated in FIGS. 4*a* to 4*d* and 5*a* to 5*d*, is provided as described above in the context of FIG. 3*c*, apart from the fact that the ends 1.2.2, 1.2.3 of the axis 1.2.1 have straight parts which are housed in corresponding seats provided on the movable element 1.6, respectively on said portion 12.1 of the frame in which, preferably, stones having an opening of diameter slightly greater than the straight portions are driven so as to reduce the frictional forces. Alternatively, the axis of rotation 1.2.1 of this device could be formed as in the first embodiment, or as described above in the context of FIGS. 3*a* and 3*b*.

In the example illustrated in FIGS. 4*a* to 4*d* and 5*a* to 5*d*, the tilt point b of the axis of rotation 1.2.1 of the coupling wheel 1.2 in accordance with the second embodiment then is not arranged in the plane of rotation p of the entry wheel 1.1 and of the first exit wheel 1.3. However, the point b is in this case arranged close to this plane p, given that the ratio d:h between the diameter d of the coupling wheel 1.2 and the height h of the axis of rotation 1.2.1 comprised between the intersection thereof with said plane of rotation p and the end mounted on the movable element 1.6 is in this design selected so as to be greater than the value selected for the design in accordance with the first embodiment, in which the point b is located by default in the plane p. Thus, if the ratio d:h between the diameter d of the coupling wheel 1.2 and the effective height h of the axis of rotation 1.2.1 is in the first embodiment of the device, preferably, approximately from 1.5:1 to 6:1, this ratio d:h is, in the second embodiment of the device, preferably approximately from 8:1 to 20:1. Thus, the diameter of the coupling wheel 1.2 shown in FIGS. 4*a* to 4*d* and 5*a* to 5*d* is for example between 4 mm and 5 mm, whereas the effective height h of the axis of rotation 1.2.1 is approximately 0.4 mm, corresponding to a ratio d:h from 10:1 to 12.5:1. Generally, said ratio between the diameter of the coupling wheel 1.2 and the height of the axis of rotation 1.2.1 comprised between the intersection thereof with said plane of rotation p and the end mounted on the movable element 1.6, also referred to above as the effective height h, is thus within the range of values from 1.5:1 to 20:1, preferably between 2:1 and 12:1. This allows, depending on the physical layout selected for the axis of rotation 1.2.1 of the coupling wheel 1.2, to ensure that the tilt point b of the coupling wheel 1.2 is arranged in, or substantially close to, the plane of rotation p of the entry wheel 1.1 and of the first exit wheel 1.3. Clearly, the ratios d:h cited above could also be expressed in terms of corresponding angles, in particular in terms of tilt angle of the axis of rotation 1.2.1 relative to the normal to said plane of rotation p of the entry wheel 1.1 and of the first exit wheel 1.3, or in terms of tilt angle of the coupling wheel 1.2 relative to this plane of rotation p. This angle leads, in spite of the small values thereof and thanks to the ratio d:h selected suitably, to a sufficiently large spacing to allow the disengagement of the toothings on the coupling wheel 1.2 and the first exit wheel 1.3.

Consequently, the axis of rotation 1.2.1 of the coupling wheel 1.2 can then also, in the second embodiment of the coupling device in accordance with the present invention illustrated in FIGS. 4*a* to 4*d* and 5*a* to 5*d*, be inclined relative to the normal to the plane of rotation p of the entry wheel 1.1 and of the exit wheel 1.3, moreover by angular pivoting of the coupling yoke 1.6, these pivots being controlled by the column wheel 11 in a manner known to the person skilled in the art. Although the second embodiment of the device has been described primarily in order to show variants of the axis of rotation 1.2.1 and of the application, it is clear that the corresponding chronograph mechanism could be realised while providing a post 1.5 that is fixed to the frame of the timepiece and that has an end in the form of a ball joint serving as the pivot point b of the axis of rotation 1.2.1 of the coupling wheel 1.2, as described by way of example in the context of the first embodiment for the application in a time-setting device. Given that an integration of the coupling device according to the embodiment in a chronograph mechanism allows to more easily increase the diameter d of the coupling wheel, this example shows that the device can be adapted depending on the application thereof and thus has a certain versatility.

The operation of the coupling device in accordance with the second embodiment is entirely analogous to that which has been explained in relation to FIGS. 1*a* to 1*c* and 2*a* to 2*c* illustrating the operation of the device in accordance with the first embodiment, apart from the fact that the tilting of the coupling wheel 1.2 produces only a coupling or a decoupling of the chronograph wheel, without further consequences.

In view of the layout and the operation of the device described above, it is understood that a coupling device according to the present invention allows to eliminate the parasitic rotation that is produced in conventional devices, given that the coupling and the decoupling are performed by tilting. In addition, the device is provided in a particularly simple manner by using only a number of parts strictly necessary. In particular, given that the coupling, respectively the decoupling is produced in principle by providing the coupling wheel with a sufficiently large diameter relative to the effective height of the axis thereof so as to allow the disengagement thereof from at least the first exit wheel, the height of the device can be reduced. Due to this fact, the device has a minimal bulk and is suitable for integration even in extra-flat movements. At the same time, it is provided with certain and reliable operation. These advantages are obtained whilst ensuring that the coupling device according to the present invention can be used for a number of applications and thus has great versatility. In particular, this coupling device can be integrated advantageously in time-setting devices, chronograph watches or split-seconds chronograph watches, or also for any function where the user can make a choice of correction or manipulation or also a system in which it is desirable to be able to connect or disconnect, for example a decoupling of an automatic. Generally, it can be integrated in any sort of timepiece, preferably in mechanical wristwatches, but it is also possible to use it in electronic watches.

The invention claimed is:

1. A coupling device for timepieces, in particular for time-setting devices or chronograph watches, the device comprising: an entry wheel, a coupling wheel meshing with the entry wheel, and at least one first exit wheel, said coupling wheel being disposed in a manner substantially coplanar relative to the plane of rotation of the entry wheel and of the first exit wheel and being arranged such that it is adapted to tilt relative to said plane of rotation so as to be able to occupy at least a first coupling position in which the coupling wheel meshes with the entry wheel and the first exit wheel and a second coupling position in which the coupling wheel meshes with the entry wheel and is decoupled from the first exit wheel, the device also comprising a movable element allowing control of the change of position between the first and the second position of the coupling wheel, wherein said coupling wheel defines an axis of rotation adapted to be inclined relative to the normal to said plane of rotation of the entry wheel and of the first exit wheel by being mounted pivotably at each of the ends thereof, at least one end of said axis of rotation being mounted on said movable element, and in that the ratio between the diameter of the coupling wheel and the height of the axis of rotation comprised between the intersection of said axis of rotation with said plane of rotation and the end mounted on the movable element is greater than 1.5:1.

2. The coupling device according to claim 1, wherein said ratio between the diameter of the coupling wheel and the height of the axis of rotation comprised between the intersection of said axis of rotation with said plane of rotation and the end mounted on the mobile element is comprised within a range of values from 1.5:1 to 20:1.

3. The coupling device according to claim 2, wherein said ratio is within a range of values from 2:1 and 12:1.

4. The coupling device according to claim 1, wherein a tilt point of the coupling wheel is arranged in, or substantially close to, the plane of rotation of the entry wheel and of the first exit wheel.

5. The coupling device according to claim 1, further comprising a post, of which the end serves as a tilt point of the axis of rotation of the coupling wheel.

6. The coupling device according to claim 1, wherein the other end of said axis of rotation is constrained by a fixed part of the frame of the timepiece.

7. The coupling device according to claim 1, wherein the other end of said axis of rotation is mounted on a second movable element.

8. The coupling device according to claim 1, wherein the entry wheel has a greater thickness, equivalent substantially to a multiple of the thickness of said at least one first exit wheel.

9. The coupling device according to claim 1, further comprising at least one second exit wheel.

10. The coupling device according to claim 1, wherein said movable element comprises a resilient arm.

11. The coupling device according to claim 1, wherein said movable element comprises a guide limiting the movement of said movable element and defining the maximum tilt thereof in the first and the second coupling position, respectively the end positions of the coupling wheel.

12. The coupling device according to claim 11, wherein said guide is selected from a group comprising an elongated opening in cooperation with a pin, two horns in cooperation with a pin, and a protruding portion in cooperation with two pins.

13. The coupling device according to claim 1, wherein centers of the entry wheel, of the coupling wheel, and of the first exit wheel are aligned or form a right angle.

14. A time-setting device comprising a winding stem adapted to occupy at least three axial control positions, a winding pinion mounted so as to be freely rotatable about the winding stem, a sliding pinion mounted slidingly on the winding stem, the sliding pinion being rotatably connected to the winding stem and adapted to mesh with said winding pinion when the winding stem is in the first axial position thereof, a setting and correction wheel forming an entry wheel and being adapted to mesh with said sliding pinion when the winding stem is in the second or third axial position thereof, a pull-out piece controlled by the winding stem and allowing displacement of the sliding pinion between a first winding position in which the sliding pinion meshes with said winding pinion when the winding stem is in the first axial control position thereof, and a second correction position in which the sliding pinion meshes with said setting and correction wheel when the winding stem is in the second or third axial control position thereof; a first correction wheel forming a first exit wheel and adapted to be kinematically connected to the setting and correction wheel when the winding stem is in the second axial position thereof, and a second correction wheel forming a second exit wheel and adapted to be kinematically connected to the setting and correction wheel when the winding stem is in the third axial position thereof, and a coupling device according to claim 1, said movable element being formed by a coupling yoke and cooperating with said pull-out piece so as to control a change of position between the first and the second coupling position of the coupling wheel, the latter meshing with the first correction wheel in the first coupling position thereof and with the second correction wheel in the second coupling position thereof, the coupling wheel being decoupled from the first correction wheel in this second position of the coupling device.

15. The time-setting device according to claim 14, wherein said coupling yoke comprises a control portion adapted to cooperate with said pull-out piece so as to be able to occupy a first and a second tilt position in which the coupling wheel is in the first, respectively the second coupling position thereof, said control portion preferably comprising a first section in the form of an are of a circle and a second section in the form of an offset arc of a circle.

16. The time-setting device according to claim 14, wherein said first correction wheel and the second correction wheel are selected from a group comprising the date fast correction wheel, the time-setting wheel, and the chronograph wheel.

17. A chronograph mechanism, intended to be integrated in a chronograph watch, comprising a chronograph seconds hand mounted on a chronograph wheel forming an exit wheel, a chronograph minutes hand mounted on a chronograph minutes wheel, a seconds wheel forming an entry wheel and driven by a geartrain of the movement of the chronograph watch, and a control means allowing to start and stop measurement of a measured time, and a coupling device according to claim 1, said movable element being formed by a coupling yoke cooperating with said control means so as to control the change of position between the first and the second coupling position of the coupling wheel, the latter meshing, in the first coupling position thereof, with the chronograph wheel, the coupling wheel being decoupled from the chronograph wheel in the second coupling position thereof.

18. The chronograph mechanism according to claim 17, wherein the control means consists of a column wheel cooperating with the coupling yoke so as to control the inclination of the axis of rotation of the coupling wheel by controlling the angular position of said coupling yoke.

19. A timepiece, in particular a mechanical wristwatch, comprising:

a coupling device, including: an entry wheel, a coupling wheel meshing with the entry wheel, and at least one first exit wheel, said coupling wheel being disposed in a manner substantially coplanar relative to the plane of rotation of the entry wheel and of the first exit wheel and being arranged such that it is adapted to tilt relative to said plane of rotation so as to be able to occupy at least a first coupling position in which the coupling wheel meshes with the first entry wheel and the first exit wheel and a second coupling position in which the coupling wheel meshes with the first entry wheel and is decoupled from the first exit wheel, the coupling device also comprising a movable element allowing control of the change of position between the first and the second position of the coupling wheel, wherein said coupling wheel defines an axis of rotation adapted to be inclined relative to the normal to said plane of rotation of the entry wheel and of the first exit wheel by being mounted pivotably at each of the ends thereof, at least one end of said axis of rotation being mounted on said movable element, and in that the ratio between the diameter of the coupling wheel and the height of the axis of rotation comprised between the intersection of said axis of rotation with said plane of rotation and the end mounted on the movable element is greater than 1.5:1, a time-setting device, including: a winding stem adapted to occupy at least three axial control positions, a winding pinion mounted so as to be freely rotatable about the winding stem, a sliding pinion mounted slidingly on the winding stem, the sliding pinion being rotatably connected to the winding stem and adapted to mesh with said winding pinion when the winding stem is in the first axial position thereof a setting and correction wheel forming an entry wheel and being adapted to mesh with said sliding pinion when the winding stem is in the second or third axial position thereof, a pull-out piece controlled by the winding stem and allowing displacement of the sliding pinion between a first winding position in which the sliding pinion meshes with said winding pinion when the winding stem is in the first axial control position thereof, and a second correction position in which the sliding pinion meshes with said setting and correction wheel when the winding stem is in the second or third axial control position thereof, a first correction wheel forming a first exit wheel and adapted to be kinematically connected to the setting and correction wheel when the winding stem is in the second axial position thereof and a second correction wheel forming a second exit wheel and adapted to be kinematically connected to the setting and correction wheel when the winding stem is in the third axial position thereof, said movable element being formed by a coupling yoke and cooperating with said pull-out piece so as to control a change of position between the first and the second coupling position of the coupling wheel, the latter meshing with the first correction wheel in the first coupling position thereof and with the second correction wheel in the second coupling position thereof, the coupling wheel being decoupled from the first correction wheel in this second position of the coupling device.

20. A timepiece, in particular a mechanical wristwatch, comprising:

a coupling device, including: an entry wheel, a coupling wheel meshing with the entry wheel, and at least one first exit wheel, said coupling wheel being disposed in a manner substantially coplanar relative to the plane of rotation of the entry wheel and of the first exit wheel and being arranged such that it is adapted to tilt relative to said plane of rotation so as to be able to occupy at least a first coupling position in which the coupling wheel meshes with the first entry wheel and the first exit wheel and a second coupling position in which the coupling wheel meshes with the first entry wheel and is decoupled from the first exit wheel, the coupling device also comprising a movable element allowing control of the change of position between the first and the second position of the coupling wheel, wherein said coupling wheel defines an axis of rotation adapted to be inclined relative to the normal to said plane of rotation of the entry wheel and of the first exit wheel by being mounted pivotably at each of the ends thereof, at least one end of said axis of rotation being mounted on said movable element, and in that the ratio between the diameter of the coupling wheel and the height of the axis of rotation comprised between the intersection of said axis of rotation with said plane of rotation and the end mounted on the movable element is greater than 1.5:1, and a chronograph mechanism, including: a chronograph seconds hand mounted on a chronograph wheel forming an exit wheel, a chronograph minutes hand mounted on a chronograph minutes wheel, a seconds wheel forming an entry wheel and driven by a geartrain of the movement of the chronograph watch, and a control means allowing starting and stopping measurement of a measured time, said movable element being formed by a coupling yoke cooperating with said control means so as to control the change of position between the first and the second coupling position of the coupling wheel, the latter meshing, in the first coupling position thereof, with the chronograph wheel, the coupling wheel being decoupled from the chronograph wheel in the second coupling position thereof.

21. A timepiece, in particular a mechanical wristwatch, comprising:

a first coupling device and a second coupling device, each of the coupling devices including: an entry wheel, a coupling wheel meshing with the entry wheel, and at least one first exit wheel, said coupling wheel being disposed in a manner substantially coplanar relative to the plane of rotation of the entry wheel and of the first exit wheel and being arranged such that it is adapted to tilt relative to said plane of rotation so as to be able to occupy at least a first coupling position in which the coupling wheel meshes with the entry wheel and the first exit wheel and a second coupling position in which the coupling wheel meshes with the entry wheel and is decoupled from the first exit wheel, the coupling device also comprising a movable element allowing control of the change of position between the first and the second position of the coupling wheel, wherein said coupling wheel defines an axis of rotation adapted to be inclined relative to the normal to said plane of rotation of the entry wheel and of the first exit wheel by being mounted pivotably at each of the ends thereof, at least one end of said axis of rotation being mounted on said movable element, and in that the ratio between the diameter of the coupling wheel and the height of the axis of rotation comprised between the intersection of said axis of rotation with said plane of rotation and the end mounted on the movable element is greater than 1.5:1, a time-setting device, including: a winding stem adapted to occupy at least three axial control positions, a winding pinion mounted so as to be freely rotatable about the winding stem, a sliding pinion mounted slidingly on the winding stem, the sliding pinion being rotatably connected to the winding stem and adapted to mesh with said winding pinion when the winding stem is in the first axial position thereof, a setting and correction wheel forming an entry wheel and being adapted to mesh with said sliding pinion when the winding stem is in the second or third axial position thereof, a pull-out piece controlled by the winding stem and allowing displacement of the sliding pinion between a first winding position in which the sliding pinion meshes with said winding pinion when the winding stem is in the first axial control position thereof, and a second correction position in which the sliding pinion meshes with said setting and correction wheel when the winding stem is in the second or third axial control position thereof, a first correction wheel forming a first exit wheel and adapted to be kinematically connected to the setting and correction wheel when the winding stem is in the second axial position thereof, and a second correction wheel forming a second exit wheel and adapted to be kinematically connected to the setting and correction wheel when the winding stem is in the third axial position thereof, said movable element being formed by a coupling yoke and cooperating with said pull-out piece so as to control a change of position between the first and the second coupling position of the coupling wheel of the first coupling device the latter meshing with the first correction wheel in the first coupling position thereof and with the second correction wheel in the second coupling position thereof, the coupling wheel of the first coupling device being decoupled from the first correction wheel in this second position of the first coupling device, and a chronograph mechanism, including: a chronograph seconds hand mounted on a chronograph wheel forming an exit wheel, a chronograph minutes hand mounted on a chronograph minutes wheel, a seconds wheel forming an entry wheel and driven by a geartrain of the movement of the chronograph watch, and a control means allowing starting and stopping measurement of a measured time, the control means meshing, in the first coupling position thereof, with the chronograph wheel, the coupling wheel of the second coupling device being decoupled from the chronograph wheel in the second coupling position of the second coupling device.

* * * * *